US005509342A

United States Patent [19]

Augsburger

[11] Patent Number: 5,509,342

[45] Date of Patent: Apr. 23, 1996

[54] EXTENDED LENGTH BASS DRUM PEDAL

[76] Inventor: Brad Augsburger, 16111 Chastain Rd., Odessa, Fla. 33556

[21] Appl. No.: 402,718

[22] Filed: Mar. 13, 1995

[51] Int. Cl.[6] ..... G10D 13/02

[52] U.S. Cl. ..... 84/422.1; 84/422.2

[58] Field of Search ..... 84/422.1, 422.2

[56] References Cited

U.S. PATENT DOCUMENTS 4,262,576 4/1981 Gorsky et al. ..... 84/422.1

4,788,897 12/1988 Kirby et al. ..... 84/422.1

*Primary Examiner*—Steven L. Stephan
*Assistant Examiner*—Cassandra C. Spyrou
*Attorney, Agent, or Firm*—Dominik & Stein

[57] ABSTRACT

A foot pedal assembly which has the same general operating components as a conventional foot pedal assembly, but with a comparatively exaggerated length of the foot pedal part. The longer foot pedal can be played with the same feel as a conventional foot pedal, and allows the staging of bass drums further away from the percussion artist than had conventionally been possible.

7 Claims, 2 Drawing Sheets

EXTENDED LENGTH BASS DRUM PEDAL

BACKGROUND OF THE INVENTION

1. Field of the Invention

The present invention concerns a foot pedal for actuation of a bass drum. More specifically, the present invention relates to a mechanical foot pedal which operates and feels like a conventional foot pedal, but with which a remote bass drum can be actuated.

2. Description of the Related Art

Percussion instruments are played by beating or striking. A percussion artist may set up a variety of drums, cymbals and related instruments to increase his vocabulary. However, in order to be playable, each percussion instrument must be placed within easy striking range. Percussion instruments take up space and the space available within the striking range is limited. Until now, artist have optimized the use of the available space by arranging the percussion instruments in roughly three tiers—an upper tier with cymbals, high-hats, and lighter weight instruments of higher registry; a middle tier with drums having horizontal playing surfaces; and a lower tier with bass drums having a vertical playing surface.

Since the instruments must be placed within easy striking distance, the only other strategy for increasing the number of instruments other than tiering has been to arrange the instruments in a larger arc around the artist. However, in practice, the useful playable range of an arc is limited to about 90°. Some artists have nevertheless found it necessary to set up percussion instruments about an arc of as much as 270° in order to stage all the instruments needed for a full range of expression. Even though many instruments can be collected about an arc of 270°, the artist can not simultaneously play instruments located in front of him and behind him. Other artists have felt the need to set up two or more drum sets next to each other in order to stage all the desired percussion instruments. Such multiple setups are, however, obviously not optimal in that they require the artist to travel from one arc to the next, and in that they necessitate the duplication of certain of the instruments, which can be of considerable expense.

There is a need for further improving the percussion instrument cluster so that more instruments can be operated from within a smaller arc.

Considering the vertical bass drums in particular, these instruments take up much space. There are presently known pedal actuated drum beating mechanisms which employ a foot pedal mechanism to drive a pivoting beater arm, the beater arm having a generally cylindrical beater head attached to one end. The foot pedal and the beater arm are both designed to pivot and are usually attached to a common base or frame, with the foot pedal operatively connected to the beater arm such that depressing the foot pedal causes the beater head end of the beater arm to describe an arc and impact a vertical surface of a drum.

Most conventionally, the lower end of the beater arm is mounted to as to be capable of pivoting about a horizontal axis. After the downward foot pressure has been removed from the foot pedal, the pedal returns upwardly to it's starting position by spring action, and the beater arm returns to it's starting position either as a result of being connected to the foot pedal, or by independent spring means. A foot pedal normally takes the form of a simple flat plate. This form of foot pedal assembly is designed to be operated by a rocking action, with the player's foot flat on the foot plate, and pivoting on the heel, but is most commonly played by suspending the heel in the air and "bouncing" the ball and toes of the foot on the foot pedal.

U.S. Pat. No. 3,426,640 describes a prior art foot pedal assembly, and is specifically concerned with a quick connect arrangement for securing the foot pedal assembly to a drum.

U.S. Pat. No. 3,930,431 discloses a foot pedal assembly which includes a pivoted footplate. The plate is adjustable for both height and proximity to the beater to suit the personal preferences of the individual player.

U.S. Pat. No. 5,301,592 teaches a bass drum foot pedal having a variable drive lever linkage with variable arc ratios connecting the foot pedal to the beater drum and having an electronic device actuator carried by a beater support member, the actuator being operable with the pedal being attached to a drum or attached to an electronic device which replaces a drum.

U.S. Pat. No. 5,317,946 teaches a beater for a drum pedal, the beater comprising a beater arm and a beater body, wherein the beater body is adjustable about a horizontal axis so that the flat surface of the beater body can be set to contact flush with the vertical surface of the drum.

U.S. Pat. No. 4,958,549 teaches a pedal mechanism for a bass drum with a primary platform for depressing with the toe, and a resiliently mounted secondary platform for depressing with the heel.

It will be apparent that a wide variety of bass drum pedals have been developed over the years in order to accommodate the tastes and requirements of the percussion artist. However, no pedal has been proposed or developed which will permit the artist to better use the limited available space as it relates to bass drums. No pedal has been proposed or developed which will allow the artist to stage bass drums outside his immediate striking range.

SUMMARY OF THE INVENTION

An object of the invention is to provide a means for further optimizing the instrument layout for a percussion instrument setup.

A further object of the invention is to provide a bass drum pedal assembly capable of striking a bass drum located beyond what has been the conventional reach of the percussion artist, yet which provides a natural and comfortable playing action and which allows high volume to be achieved while maintaining precise control over the movement of the beater head. Such a pedal can be used to make possible the staging of a base drum further away from the artist than hitherto possible, freeing up much space in the immediate vicinity of the artist for staging of various other percussion instruments.

It is a further object of the invention to provide a means for modification of a conventional bass drum pedal in order to enable it to strike a bass drum located beyond what has been the conventional reach of the percussion artist.

After extensive investigation and experimentation, the present inventor has discovered that the objects of the invention can be simply, eloquently, and inexpensively accomplished by means of a foot pedal assembly which has the same general operating components as a conventional foot pedal assembly, but with the main difference being the comparatively exaggerated length of the foot pedal part. Conventionally, the foot pedal is designed to be slightly longer than the foot. For example, feet are generally 10 to 12 inches in length, and foot pedals are conventionally 13 to 15 inches in length. The foot pedal part of the foot pedal assembly of the present invention is generally 1½ to two times the length of the foot, i.e., 16 to 24 inches in length. The frame is likewise extended in length, but the remaining components of the foot pedal assembly may be any of those conventionally available.

The longer reach of the foot pedal thus modified permits the placement of the bass drum further away from the artist than has hitherto been possible, and permits greater flexibility and latitude in the staging of the collection of percussion instruments in the playing arc of the artist.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other footpedal assemblies for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made the following detailed description taken in with the accompanying drawing in which.

DETAILED DESCRIPTION OF THE INVENTION

Figure 1:
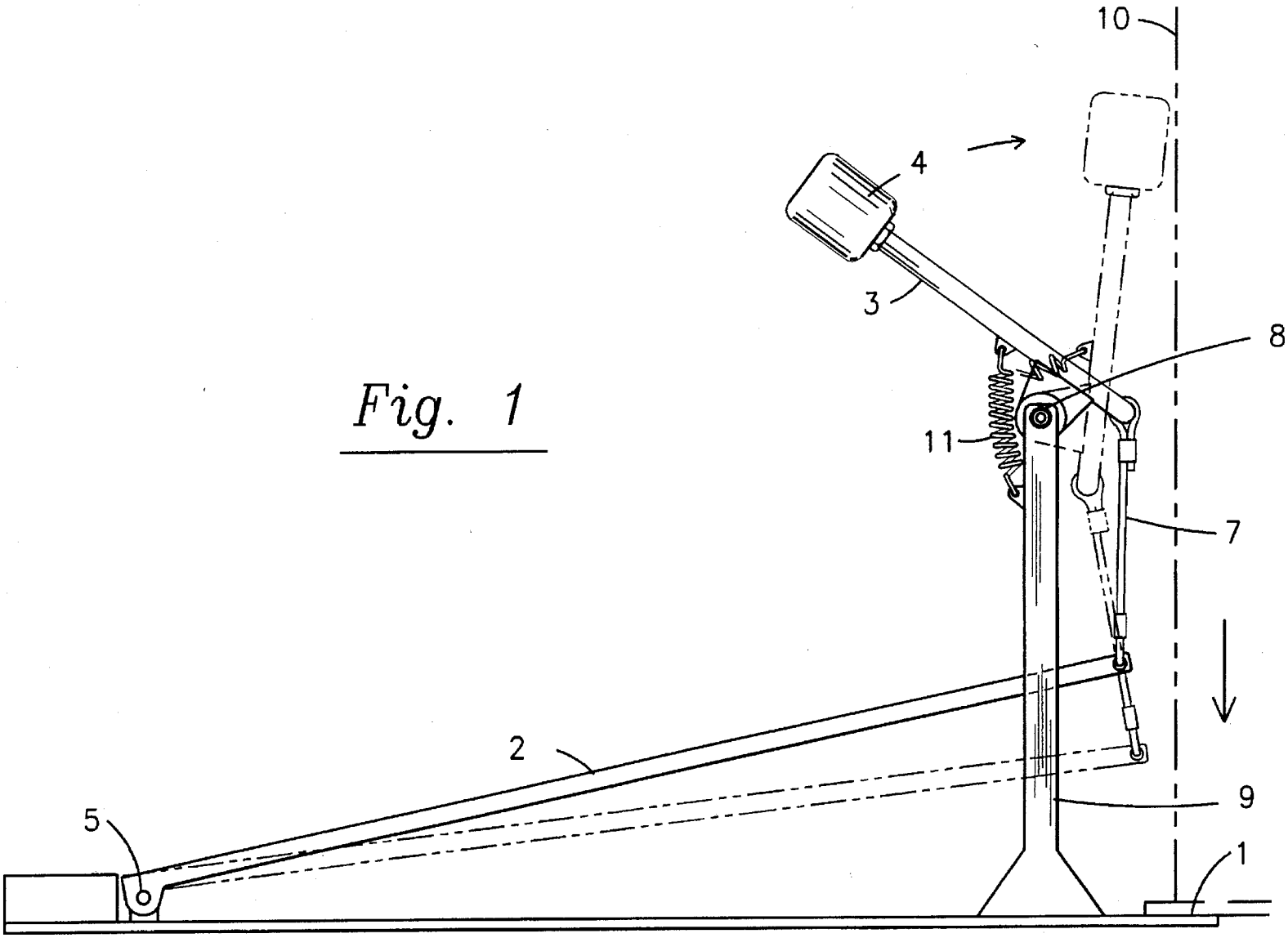
FIG. 1 is a side view of a drum pedal according to the invention with solid lines representing the rest position and broken lines representing the operating position.

The most significant feature of the present invention is the characteristic that the foot pedal is longer than conventional, thus permitting the staging of the bass drum further away from the percussion artist and freeing up valuable space for the placement of other percussion instruments.

The present invention runs contrary to the conventional wisdom that the foot pedal should approximate the length of the foot. It has been the conventional understanding that the lever represented by the foot pedal should be as short as possible, so that the force of the foot on the pedal is readily transmitted to the beater arm. The present invention goes against the conventional wisdom and extends the foot pedal significantly beyond the length of the foot. Surprisingly, even such an unusual configuration can be operated with a normal action and feel.

The bass drum assembly of the present invention may incorporate any of the design features, operating layouts, materials, and hardware of any of the conventional bass drum pedal assemblies, except that the foot pedal and the frame are generally 1½ to two times the normal length. For example, the length of the foot pedal may be 16 to 30 inches, preferably 18 to 24 inches, measured from the pivot axis at the heel to the point of attachment of the linkage to the beater arm.

The frame is likewise extended in length to accommodate the extended pedal.

However, all the remaining components of the foot pedal assembly may be any of those conventionally available, including those disclosed in U.S. Pat. No. 3,426,640, U.S. Pat. No. 3,930,431, U.S. Pat. No. 5,301,592, U.S. Pat. No. 5,317,946, U.S. Pat. No. 4,958,549, and the patents cited in these patents. The disclosures of these patents with regard to conventional arrangements and hardware is expressly incorporated herein by reference.

Generally, the assembly includes a foot pedal comprising a footplate and a footplate support which is pivotally coupled at the heel end thereof to the base, and which is inclined upwardly towards a toe end. The toe end is generally disposed below the beater head, but alternative embodiments are known. The foot pedal also includes means biasing the footplate towards its rest position. The footplate support is coupled to the beater head so that downward movement of the foot pedal causes the head to pivot about the mounted axis to bring the beater element towards its beating position.

The beater arm may be any of a rod, a bar, a plurality of bars, or any generally rigid means for carrying the beater element and transmitting the torque force from the foot pedal.

When the player exerts downward pressure on the foot pedal, he will cause the beater head to swing forward, bringing the beater element into contact with the drum. At the end of the stroke, the player relaxes and allows the foot pedal to be returned upwardly by spring means and allows the footplate to be returned to its rest position by, for example, springs, ready for the next stroke. The player's foot remains in contact with the footplate throughout this movement so that the player retains control over the motion of the beater head. The player can lift his heel from the footpedal and essentially play using the ball of his foot so that less heel flexing is required and easier activation is made possible.

It is quite surprising that a foot pedal which is approximately two times as long as a conventional foot pedal can still be used and played in the conventional manner. That is, it would be expected that the increased force required to act on the lever would make it more difficult to cause the beater arm to operate. However, contrary to expectations, it has been discovered that (1) the foot pedal can be played with the same ease and feel as a conventional foot pedal, and (2) the foot pedal so constructed makes possible the removal of the bass drum to a position further from the percussion artist, freeing up valuable close-in space for the staging of other percussion instruments.

An upright projects upwardly from the base casing and forms the support on which the beater head is mounted. The beater arm may be slidably received in a mounting block so that the vertical position of the beater element may be adjusted and set by set screws to suit the preference of a particular player.

Referring now for illustrative purposes to FIG. 1 for one non-limiting example of a pedal assembly, the assembly comprises a base 1, a foot pedal 2, and a beater including a beater arm 3 and a beater element 4 carried at an outer end of the beater arm. The beater arm 3 operates as a rocker, pivoting about a horizontal axis as defined by the retaining pin 8 which connects the beater arm 3 to an upright 9 projecting up from the base 1.

The foot pedal 2 is pivotably connected at a first end to the base 1 in the area of the heel of the foot pedal part by articulating hinge means 5. The other end of foot pedal 2 is connected via linkage 7 to the end of the beater arm 3 opposite the beater element 4. Spring means 11 urges the beater arm to the rest position when there is no foot pressure on pedal 2.

Linkage 7 may be cable, leather, articulated chain, or a solid element.

The spring means 11 may be of any construction capable of storing tension or torsional energy as return energy, but preferably comprises a metal spring member in the shape of a helical coil, coiled about an axis. The spring means may be made of any suitable resilient material, and is preferably made of metal, but may be any other spring means such an elastic cord such as a bungee type elastic cord. As the foot pedal is depressed, spring 11 is stretched, creating a restoring torsional force which urges the foot pedal and the beater arm to tend to counter-rotate and return to the rest position.

The beater element 4 may be a generally cylindrical beater head, or it may be a beater head with a flat face adapted for engaging with the vertical surface of a bass drum.

One end of the foot pedal and one part of the beater arm are both attached to a common base or frame which maintains the spatial relationship between the foot pedal and beater arm. The foot pedal 2 is operatively connected to the beater arm 3 such that depressing the foot pedal 2 causes the beater element 4 end of the beater arm 3 to describe an arc and impact a vertical surface of a drum 10 (the operating position of the beater arm shown in FIG. 1 in broken lines).

Most conventionally, the beater arm is mounted at a point near the opposite end of the beater head so as to be capable of pivoting about a horizontal axis. After the foot pedal has been depressed, the pedal is returned upwardly to it's starting position by spring action.

Means such as upright 9 is provided on said base supporting the beater arm adjacent one end of said arm for pivotal movement about an axis which is disposed generally horizontally when the assembly is in use and is spaced apart from the floor of the base so that the beater element can move between a forward, beating position for contact with the drum, and a retracted or rest position. Means is provided for biasing the beater head towards the retracted position of the beater element.

Other forms of coupling means, such as rigid links, chain links, leather straps, etc. can be provided between the footplate support and the beater head.

Figure 2:
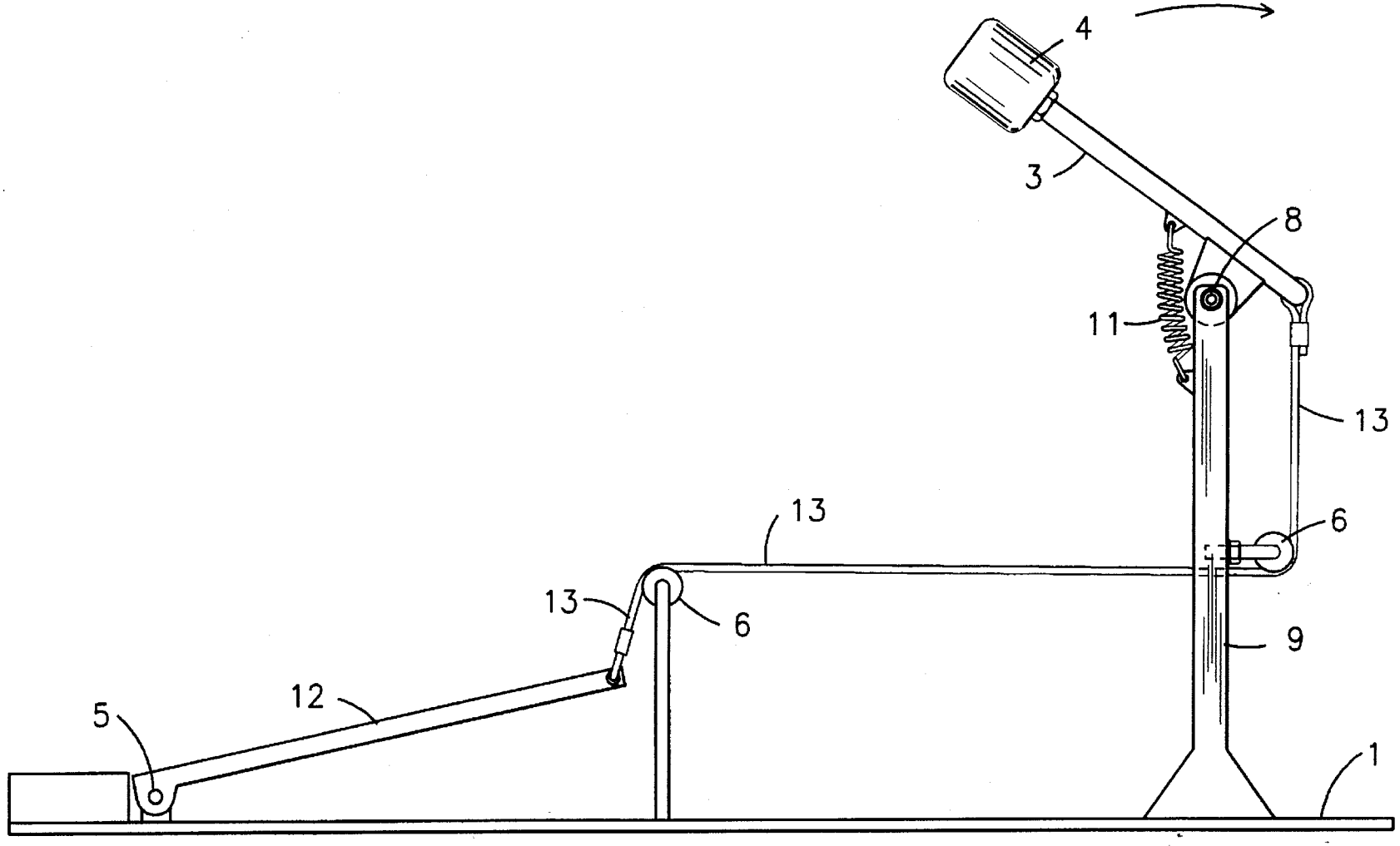
FIG. 2 is a side view of a second embodiment of a drum pedal according to the invention, on the same scale as FIG. 1, but using alternative linkage means.

A less preferred embodiment of the invention is shown in FIG. 2. From FIG. 2 it can be seen that foot pedal 2 is operated in the conventional manner to cause beater arm 3 to operate also in a normal manner, but that the long foot pedal 2 and short linkage 7 are replaced by a conventional foot pedal 12 and long linkage 13 connecting the foot pedal to the beater arm via pulleys 6.

In addition to originally manufacturing and providing the drum pedal assembly with the design as discussed above, it will be readily apparent that conventional drum pedals can be modified according to the present invention by (1) extending the base, and (2) providing an attachment to the foot pedal to increase the length or, in the case of the conventional foot pedal and the extended linkage, by providing the extended base and the extended linkage.

The present invention may be made applicable to many of the existing drum setups by modifying the already known foot pedal assemblies. For example, U.S. Pat. No. 5,204,485 (Lombardi) teaches a multi-axle drum beater and pedal apparatus which permits a drummer to connect a foot pedal for the left foot and a foot pedal for the right foot to a single bass drum. The setup of Lombardi requires the bass drum to be set up in a conventional location. By modifying the drum pedal of Lombardi according to the present invention, it becomes possible to not only actuate the same drum with both the left and right foot, but it becomes possible to set up the bass drum outside the conventional setup range.

In a further embodiment of the invention as shown in FIG. 2, the bass drum foot pedal assembly comprises a base, a footplate element having a heel end and a toe end and pivotally coupled at the heel end to the base so as to be capable of pivoting between a rest position and an operating position, means for biasing the footplate towards the footplate rest position, a beater arm pivotably mounted about an axis on the base for pivoting between a rest position and a beating position, and linkage means operatively connecting one end of the beater arm to the toe end of the footplate element, wherein the horizontal separation between the toe end of the footplate element and the point at which the linkage means connects with the beater arm is at least 6 inches, and wherein downward movement of the toe end of the footplate element acts, via the linkage means, to cause the beater arm to pivot about the mounted axis to bring the beater element towards the beater element beating position. This embodiment accomplishes the same objectives as the first embodiment of the invention, but uses different linkage means.

Although this invention has been described in its preferred form with a certain degree of particularity with respect to a mechanical foot pedal assembly, it is understood that the present disclosure of the preferred form has been made only by way of example and that numerous changes in the details of structures and the composition of the system may be resorted to, such as replacement of mechanical linkages with electrical linkages, without departing from the spirit and scope of the invention.

Now that the invention has been described,

What is claimed is:

1. A bass drum foot pedal assembly comprising:

a base, a footplate element having a heel end and a toe end and pivotally coupled at said heel end to said base so as to be capable of pivoting between a rest position and an operating position, means for biasing the footplate element towards the footplate element rest position, a beater arm pivotably mounted about an axis on said base for pivoting between a rest position and a beater position, and linkage means operatively connecting one end of said beater arm to said toe end of said footplate element, wherein downward movement of said toe end of said footplate element acts, via said linkage means, to cause the beater arm to pivot about the mounted axis to bring the beater arm towards the beater arm beater position, and wherein the length of said footplate element from said pivotal coupling at said heel end to the linkage coupling at said toe end is at least 18 inches.

2. A bass drum foot pedal assembly as in claim 1, wherein the length of said footplate element from said pivotal coupling at said heel end to the linkage coupling at said toe end is at least 20 inches.

3. A bass drum foot pedal assembly as in claim 1, wherein the length of said footplate element from said pivotal coupling at said heel end to the linkage coupling at said toe end is at least 22 inches.

4. A bass drum foot pedal assembly as in claim 1, wherein the length of said footplate element from said pivotal coupling at said heel end to the linkage coupling at said toe end is at least 24 inches.

5. A bass drum foot pedal assembly as in claim 1, wherein said linkage means is selected from the group consisting of a cable, a leather strap, an articulated chain, and a solid element.

6. A bass drum foot pedal assembly comprising:

a base, a footplate element having a heel end and a toe end and pivotally coupled at said heel end to said base so as to be capable of pivoting between a rest position and an operating position, means for biasing the footplate element towards the footplate element rest position, a beater arm pivotably mounted about an axis on said base for pivoting between a rest position and a beating position, and linkage means operatively connecting one end of said beater arm to said toe end of said footplate element, wherein the horizontal separation between said toe end of said footplate element and the point at which said linkage means connects with said beater arm is at least 6 inches, and wherein downward movement of said toe end of said footplate element acts, via said linkage means, to cause the beater arm to pivot about the mounted axis to bring the beater arm towards the beater arm beating position.

7. A bass drum pedal assembly comprising:

a base;

a beater arm having an outer end and an inner end and including a beater element carried at the outer end of said beater arm;

means on said base supporting said beater arm adjacent said inner end of said arm for pivotal movement about an axis which is disposed generally horizontally when the assembly is in use and is spaced above said base, whereby said beater element can move between a forward, beating position for contact with a drum, and a retracted rest position;

means for biasing said beater head towards said retracted position of said beater element and said footplate towards said footplate rest position;

a foot pedal having a toe end and a heal end and pivotably coupled at said heel end to said base for pivoting between a beating position and a rest position and inclined upwardly from said heel end towards said toe end, said foot pedal disposed generally below said beater head; and, means coupling said foot pedal to said beater head so that downward movement of said foot pedal causes said head to pivot about said axis to bring said beater element towards the beater head beating position, wherein the length of said footplate from said pivotal coupling at said heel end to the linkage coupling at said toe end is at least 18 inches.

* * * * *